United States Patent [19]

Parker

[11] Patent Number: 4,744,465

[45] Date of Patent: May 17, 1988

[54] MULTI-UNIT PACKAGE HAVING REDUCED TASTE/FLAVOR IMPARTING MATERIALS

[75] Inventor: Glenn E. Parker, Fort Branch, Ind.

[73] Assignee: Ball Corporation, Muncie, Ind.

[21] Appl. No.: 856,883

[22] Filed: Apr. 28, 1986

[51] Int. Cl.[4] ..... B65D 57/00; B65B 13/02

[52] U.S. Cl. ..... 206/597; 206/497; 229/120.32

[58] Field of Search ..... 206/499, 497, 386, 597; 53/398, 442, 447, 399; 229/120.32

[56] References Cited

U.S. PATENT DOCUMENTS

| | | | |
|---|---|---|---|
| 3,351,264 | 11/1967 | Bostrom | 206/499 |
| 3,568,393 | 3/1971 | King et al. | 53/399 |
| 3,783,006 | 1/1974 | Hahn et al. | 220/458 |
| 3,934,527 | 1/1976 | Saunders | 220/458 |
| 4,036,364 | 7/1977 | Ambrose | 206/597 |
| 4,304,804 | 12/1981 | Fitko | 220/458 |
| 4,607,476 | 8/1986 | Fulton | 53/399 |

OTHER PUBLICATIONS

A Manual for the Brewing and Beverage Industries, 1982, Chap. 23.

*Primary Examiner*—Steven Weinstein
*Attorney, Agent, or Firm*—Gilbert E. Alberding

[57] ABSTRACT

This invention relates to a multi-unit package of metal containers that have been internally coated with resins and stacked to form the package using plastic divider sheet of a prescribed composition between the tiers of containers. The subject invention is a multi-unit package comprising at least two plastic dividers for receiving and holding a plurality of open-ended metal containers having their walls coated with a resin layer, said containers having their open ends in abutting relationship with a first surface of one of said at least two plastic dividers and their bases in abutting relationship with a second surface of the second of said at least two plastic dividers, the open ends of said containers being sealingly engaged with the first surface to form closed spaces wherein migration and/or diffusion of an organoleplic active agent capable of traveling from said first surface encompassed by said open ends to said resin layer is substantially suppressed, said plastic dividers comprising polymers selected from the group consisting of polyalkyleneterephthalate and copolyesters of cycloaliphatic diols and dibasic carboxylic acids.

3 Claims, 1 Drawing Sheet

MULTI-UNIT PACKAGE HAVING REDUCED TASTE/FLAVOR IMPARTING MATERIALS

BACKGROUND OF THE INVENTION

This invention relates in general to a package articles and, more particularly, to a package of containers of the type customarily used for beverages including beer. Still more particularly, the invention relates to a packaging system for containers of multi-unit construction wherein there are provisions for substantial suppression of any flavor/taste imparting materials.

A number of different types of containers are employed in the beverage and food industry. As regards the carbonated and alcoholic containing beverages, metal containers or cans are extensively employed. The conventional drawn and ironed can consists of two components, namely a top and a can body. As known, in America the drawn and ironed two-piece can has largely replaced the three-piece can. The body portion of a two-piece can is generally made from aluminum or tinplated steel and is easily drawn into a cylindrical configuration and ironed down to a very thin wall thickness. Only the body is formed by a drawing and ironing procedure and when completed it includes a very thin side wall section and a domed end wall portion formed integrally with the side wall at one end thereof. The opposite end of the side wall is joined to a closure or can end which is usually double seamed thereon.

To produce can bodies, circular disks are stamped from metal sheet stock of the appropriate thickness. Each standard disk is drawn into a cup which is subsequently placed over a punch and forced through a die set where it is redrawn into a lesser diameter and ironed along its side wall to thereby substantially reduce the thickness of the side wall while at the same time elongating the side wall. The end wall, however, retains the original thickness of the metal sheet stock and, after the side wall is completely ironed, the punch drives the base against an end-forming die to impart a domed configuration. The domed structure enables the end wall to withstand high internal pressures without buckling outwardly and rendering the can body useable and giving it adequate column strength.

It has been the tendency to utilize thinner gauge metal stock which, in turn, produces yet still thinner side walls for containers. In production where rates often exceed several hundred per minute, cans are rapidly made by the so-called body making equipment. Thereafter, it is necessary to coat the external as well as the internal portions of the can structure. The external coatings are employed for reasons of protection and decoration, whereas the internal coatings serve mainly to protect the beverage or food ingredient from the metal surface of the container. The applied coatings are cured usually by heating and baking. Generally, the dry film thickness for the internal coating may range from about 2 to about 5 microinches when applied by a conventional spraying system. In the earlier coating systems an organic solvent was used and thereafter removed since the solvent only served as a carrier to convert the resins into a form suitable for application to the substrate. In recent times water-based coatings have been perfected and are extensively used for coating both food and beverage containers.

After the external and internal coatings are applied and cured the metal containers must be packaged in some convenient manner in order to transport or ship them to the concerns that will eventually fill the containers with beverage or food. In cans destined for the brewing industry, it is common practice to advance a unitized mass of containers onto a paperboard or chipboard structure or divider sheet stock and thereafter to place subsequent unitized masses of containers over such structures to build a tiered multi-unit package. Thus, large layers or tiers of metal containers are formed and may be readily bound by straps and thereafter shipped to the filling lines of the breweries. In practice, it has been observed in the use of paperboard, especially corrugated cardboard, that there is a propensity for various contaminating materials to cling to or collect upon the surface of such boards and, therefore, to impose or play some role in transferring unfavorable flavor/taste characteristics to the internal portions of coated metal containers. Seemingly, the contaminating materials are passed via migration or diffusion to the container walls and end up ultimately within the beverage or food product. This propensity to impart various contaminating materials or organoleptic active agents seem to be more prevalent with paperboard or chipboard, especially when such boards have been used a number of times in the shipping and handling process.

Actually, it is common practice in the industry to use the aforementioned boards four or more times in packing before they are finally discarded. In addition, moisture is readily absorbed by paperboard and it is believed that such moisture in combination with the cellulosic materials and the like that are formulated in making up such boards somehow contribute to the unfavorable flavor/taste phenomenon. Moreover, the various adhesives and binders used and their particular chemical constitutions apparently also contribute to this unfavorable situation. It may be mentioned that such conventional packaging arrangements are oftentimes placed in a warehouse prior to being used during storage. In such a condition, there may be temperature changes which contribute to the diffusion and migration of various chemical constituents from the paperboard or chipboard to the internal portions of the containers. As can be appreciated, there are ample opportunities for contaminating materials to find their way into the interior of cans and, thereafter, into the food or beverage that is eventually packaged therein.

While it is not known specifically the particular chemical constituents of the organoleptic active agents that act as contaminating materials which cause off-flavor or unfavorable flavor characteristics, a number of studies have been made which seem to indicate that such materials belong to the classes of organic compounds referred to as aldehydes and ketones. Qualitatively they influence taste or flavor even in trace concentrations, (in low parts per billion). Some of the materials that may be responsible for off-flavor include acetaldehyde, benzaldehyde, 2-nonenal and hexanal.

It is surprising that of the many possible candidates for use as plastic sheet material and, therefore, to function as divider sheet stock there are practically none that have been be found to be totally suitable. It will be appreciated that although a number of plastics or polymeric materials may have certain favorable properties as regards certain characteristics the same seemingly useful materials have other properties that make them unsuitable as plastic divider sheet stock. For example, certain plastics have the property of imparting or transferring a very small residue or film to the container surface, especially in contacting areas, such as around their open ends. The chemical makeup of such residual material may be of such a nature that there is a tendency, once transferred, to cause in a beer product the loss or reduction of its foamy head. This loss may often be traced to such materials as silicon-containing ingredients that are found in plastic sheet stocks employed for plastic divider stock. Such ingredients are often incorporated during polymerization to serve as an antiblocking agent as, for example, in the glycol-modified polyalkyleneterephthalate compositions and the like. Further, certain plastic sheet stock compositions may not actually impart any off-flavor or taste yet they may lack the proper surface characteristics, that is, they may have too little or too much resistance to sliding of the base portions of containers or cans. It is important that the surface properties of the sheet provide conditions at the interface between its plastic surface and the resin coated surface of the containers that are not too slippery. If the surface conditions are not right, particularly during the processing of advancing a plurality of containers onto the divider sheet or during their movement in subsequent shipping or handling, there is a marked tendency for the containers to slide outside the confines of the sheet and, therefore, fall or tumble resulting in a chaotic condition. Plastic materials such as the so-called high density polyethylenes as well as glycol-modified polyethyleneterephathalates exhibit this property. Further, certain plastic sheet materials are too brittle and lack the proper flexibility for transfer and manipulation. Related to this is brittleness and the tendency of some plastic materials in the form of divider sheets to split or crack with relative ease upon usage. Polypropylene has this tendency, especially at low temperatures as would be encountered in warehouses during storage. It can therefore be appreciated that in seeking a plastic sheet stock materials to satisfy all the requirements as suitable divider stock for multi-unit packages, there seemingly is no easy answer.

SUMMARY OF THE INVENTION

One principal object of this invention is to provide divider sheets for packaging containers whereby no contaminating materials that impart or influence taste or flavor are carried over or transferred thereto.

Yet another object of the subject invention is to provide a multi-unit package suitable for storage and shipping in which open-ended container are housed in an environment in which little or no absorption of organoleptic active agents takes place to cause off-flavor due to divider sheet contamination.

Still another object of the instant invention is to provide a multi-unit package comprising plastic sheets and metal containers in which the container may be readily introduced and maintained in a layered structure without concern during shipping, handling and storage of being contaminated by off-flavor agents.

The subject invention relates to a multi-unit package comprising at least two plastic dividers for receiving and holding a plurality of open-ended metal containers having their walls coated with a resin layer, said containers having their open ends in abutting relationship with a first surface of one of said at least two plastic dividers and their bases in abutting relationship with a second surface of the second of said at least two plastic dividers, the open ends of said containers being sealingly engaged with the first surface to form closed spaces wherein migration and/or diffusion of an organoleptic active agent capable of traveling from said first surface encompassed by said open ends to said resin layer is substantially suppressed, said plastic dividers comprising polymers selected from the group consisting of polyalkyleneterephthalates and copolymers of cycloaliphatic and dibasic carboxylic acids.

The particular polymers useful for the sheet divider package are the polyalkyleneterephthalates, namely, the saturated linear polyesters and the polyesters of cycloaliphatic diols and dibasic carboxylic acids. The polyalkyleneterephthalate resins may be represented by the following structural formula:

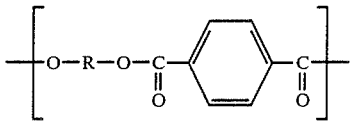

wherein R is an alkylene radical such as methylene, ethylene, propylene, butylene, pentylene and the like. A particular useful polyalkyleneterephathalate is polyethyleneterephthalate which, as is well-known, can be prepared by the reaction of either terephthalic acid or its lower alkyl ester, dimethyl terephthalate, with ethylene glycol and the resultant glycol ester polymerized to high molecular weight product.

As used herein the term "high molecular weight" means a polyester having an intrinsic viscosity (I.V.) of at least 0.60 and preferably from about 0.76 to about 1.0 as measured in 60/40 by volume mixed solvent of phenol/tetrachloroethane at 30° C. In general, such polymers have a molecular weight average of about 48,000. Such polymers are also characterized by a density of about 1.4 grams per cubic centimeter or slightly less which represents a maximum degree of crystallinity of about 23%.

The polymers derived from a cycloaliphatic diol and at least one dibasic carboxylic acid may be prepared by condensing either the cis or trans isomer (or a mixture thereof) of 1,4-cyclohexanedimethanol with at least one hexacarbocyclic dicarboxylic acid (including esters or halides thereof) so as to produce a highly polymeric, high melting linear polyalkyleneterephthalate having a molecular structure principally containing recurring units having the following formula:

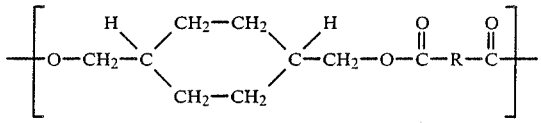

wherein the substituted cyclohexane ring is selected from the group consisting of the cis and trans isomers thereof and R represents an organic radical containing from 6 to 20 carbon atoms which is the decarboxylated residue derived from a hexacarbocyclic dicarboxylic acid.

The subject invention also includes a method of substantially reducing or suppressing the migration and/or diffusion of an organoleptic active agent within the closed spaces formed by a plurality of open-ended, internally coated containers that are slidably received by a plastic sheet and thereafter covered by another plastic sheet, said metal comprising feeding a unitized load of said plurality of open-ended containers onto one of said plastic sheets having a size corresponding substantially to the width and length of said load and, thereafter, covering said load to bring into abutting relationship the bases of said containers with one sheet and the open ends of said containers with the other sheet, said plastic sheets comprising polymers selected from the group consisting of polyalkyleneterephthalates and copolyesters formed by cycloaliphatic diols and dibasic carboxylic acids.

DESCRIPTION OF THE DRAWINGS

In the accompanying drawings which from part of the specification and wherein like numerals refer to like parts wherever they occur.

DESCRIPTION OF THE PREFERRED EMBODIMENTS

Figure 1:
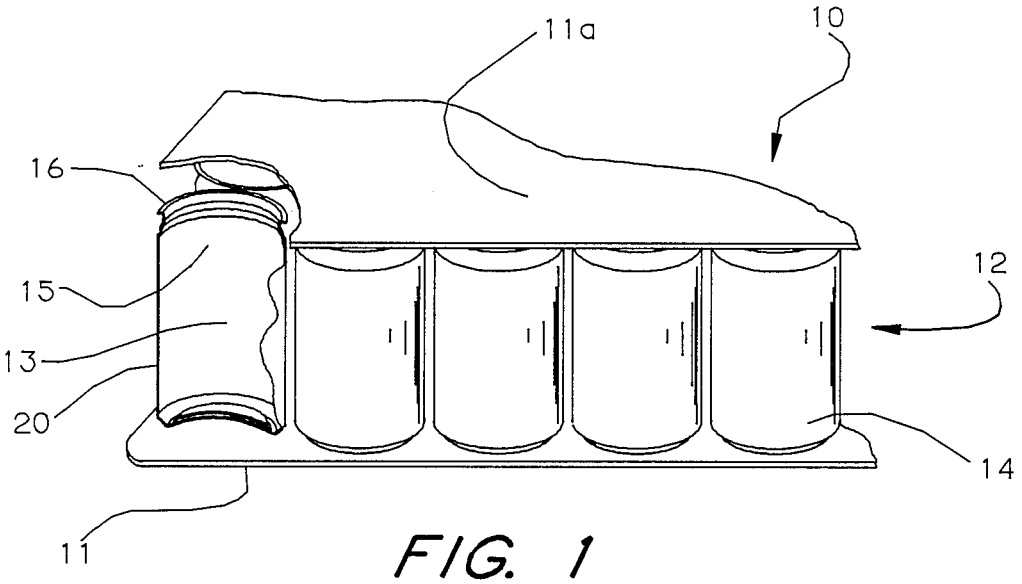
FIG. 1 is a view in perspective showing a portion of a multi-unit package of metal containers according to the subject invention.
Figure 2:
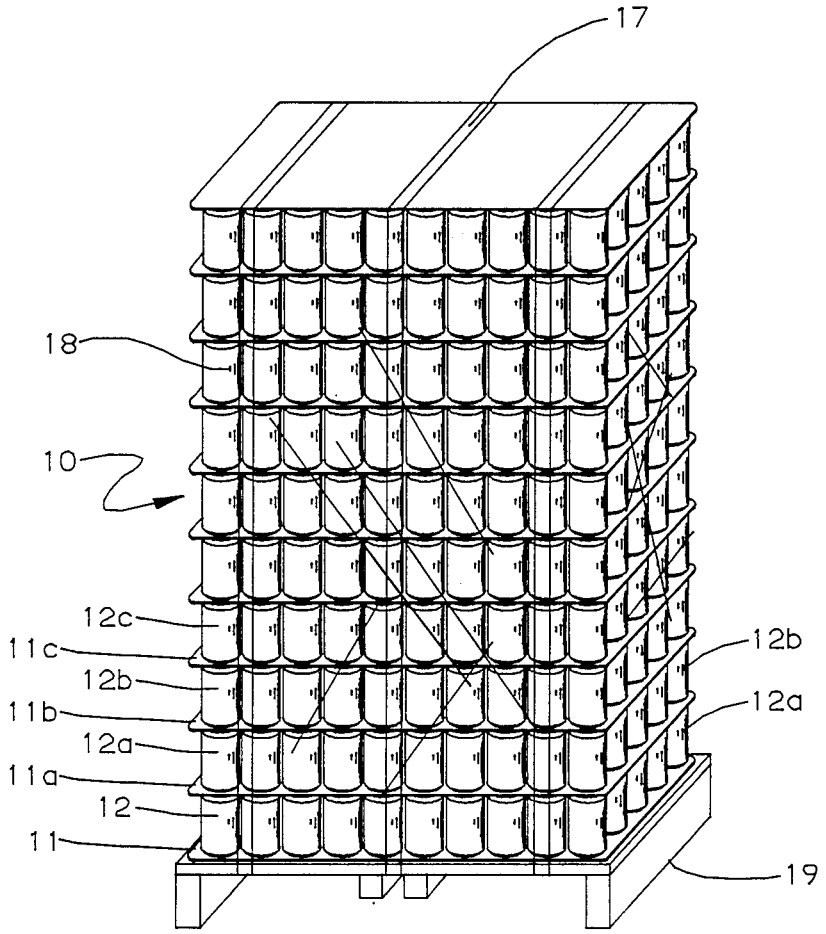
FIG. 2 is a prospective of the multi-unit package comprising the dividers and plurality of containers around which are straps and a shrink-wrap shroud.

Referring now to FIGS. 1 and 2, a multi-unit package 10 is shown comprising a plurality of plastic sheet dividers 11, 11*a*, 11*b*, etc., and unitized loads 12, 12*a*, 12*b*, 12*c*, etc., of a plurality of metal containers or cans 13, the bases 14 of said container 13 being the contact with divider 11 and the open-ends 15 of said container 13 being in contact with the dividers, 11, 11*a*, etc. It will be noted that the open-end 15 of container 13 are provided with a flat flange portion 16 integrally formed thereon and extending outwardly therefrom.

In position, a load of containers 12, generally about 320, are advanced from a holding station of a palletizer onto a plastic divider sheet 11 in such a manner that the total load 12 is slid as a unit thereon. Either by mechanical or manual means a second sheet 11*a* is placed thereover and a further load 12*b* introduced on the upper surface of the sheet 11*a*. It is by such repetition that a layered or tiered structure is built up, reaching upwards of some 10 to about 21 layers high. In practice, the size of the sheet may vary but a suitable size of practical value is 44"×56"×0.02".After forming the structure it may be secured for transportation by strapping means 17 that form continuous loops or strappings around the plurality of containers including the plastic divider sheets. Moreover, an enveloping bag or cover of heat-shrinkable plastic film 18 may be heat-shrunk over the entire group of rolls to form a dust and moisture proof covering around the layered unit. If necessary, a wooden pallet 19 may be used to hold or ship the entire layered unit as by means of a forklift truck or the like.

Each container 13 has an internal coating 20. It is believed that the coating 20 has a number of active sites that have an affinity to retain organoleptic agents. This affinity is especially noted for those resins that have been freshly set or cured on the surface of the container.

The internal coatings that are used within such containers that are sometimes prone to develop this tendency are the water-dilutable derivatives of epoxy resins as well as the epoxy/acrylic grafted polymers, i.e., those epoxy resins that are formed under conditions which favor the formation of graft copolymers (acrylic grafted to epoxy resins). These resins may be readily cured with suitable crosslinkers during heating (usually about 215° C., for 1 minute) and include the highly methoxymethylated melamine resins, such as methylated melamine formaldehyde resin, methylated urea formaldehyde resins, methylated benzoguanamine formaldehyde resins and butylated urea formaldehyde resins.

The following table shows the various polymeric materials that were employed as plastic divider stock:

| Polymers | Odor Impart | Taste | Moisture Absorption | Slide | Stiffness | Brittleness | Effects Product |
|---|---|---|---|---|---|---|---|
| 1 Polyethylene-terephthalate | + | + | + | + | + | + | + |
| 2 Polypropylene, | + | | | | | − | |
| 3 Polypropylene, 40% Talc | − | | | + | | − | |
| 4 Polypropylene 20% Talc | − | | | | | | |
| 5 Polyethylene-terephthalate, glycol-modified | + | | | − | + | + | + |
| 6 Polyethylene-terephthalate, siloxane-anti-blocked | + | | | | | | − |
| 7 K-Resin-Crystal Polystyrene | + | − | | + | − | + | + |
| 8 K-Resin/High Impact Poly-styrene | + | − | | | | | |
| 9 High Density Polyethyethene | | | | − | | | |
| 10 | − | − | − | + | + | + | + |

-continued

| Polymers | Odor Impart | Taste | Moisture Absorption | Slide | Stiffness | Brittleness | Effects Product |
|---|---|---|---|---|---|---|---|
| Cardboard | | | | | | | |

A positive sign indicates a favorable result, a negative sign indicates an unfavorable one and a blank shows no test was carried out for that property. The "Odor Impart" column as well as the "Taste" column refers to the propensity of a plastic divider sheet to impart an off-taste or odor characteristic to a beer product. The "Moisture" column indicates the tendency of the sheet to collect or retain moisture. The "Slide" column relates to the property of metal (steel or aluminum) coated cans to be easily moved as a unit onto the sheet and the ability of that unit package to be retained on that sheet without sliding or tipping over thereon. Slide is related to the coefficient of friction to a major degree. "Stiffness" is the property relating to bending or flexural ability and relates to the ease of placement or transfer during the stacking process in forming the multi-unit package of the subject invention. Brittleness refers to the ability of the material to resist impact. The last column, "Effects Product," relates to the sheet influencing the foam of the beer product by introducing in some fashion a substance that destroys or kills the formation of a head upon pouring the beverage into a clear glass. In viewing the table it can be appreciated that although plastic sheet stock made from polymer No. 6 gave a favorable showing as to its imparting no off-flavor/taste to a beer product, it was unsatisfactory because the sheet stock imparted agents that suppressed foam retention in the final product. It is believed that the loss of foam in beer for containers that were in contact with the sheet stock was brought about by the siloxane that was apparently carried over to the inner walls of the beer containers. Polymer No. 5 has a number average molecular weight of about 26,000 and a specific gravity of about 1 27. The coefficient of friction is such that containers stacked on a sheet of the plastic made from polymer No. 5 have the marked tendency to slide off with relative ease upon transfer or gentle manipulation. Thus, although the other properties tested are favorable for the material to be used as a divider stock it is unfit because of this property. The polyethyleneterephthalate used herein for divider sheet stock had a static coefficient of friction of about 0.37 $\pm$0.04 for an empty aluminum can and about 0.28 $\pm$0.02 for a steel container. Sheets of polymer No. 2 and 3 have the property of being too brittle and therefore crack or fracture upon repeated usage. Polymer No. 2 is especially prone to this at relatively low temperatures. It can be noted further from the table that sheet made from polymer Nos. 3 and 4 have an unfavorable odor carryover problem. Further, sheet fabricated from polymer Nos. 7 and 8 have a taste carryover problem. It can be readily seen in considering the polymers listed that only polymer No. 1 is fully satisfactory for plastic divider sheet.

The sheet stock of the subject invention may be readily made by conventional forming techniques. The polyethyleneterephthalate polymer may be extruded into a narrow band and thereafter rolled to reduce its thickness to that desired e.g. about 0.015 to about 0.025 inches. The polyethyleneterephthalate may be formed into an amorphous sheet of unoriented polymer.

It is to be understood that a number of modifications to the above-described invention may be made by those skilled in the art, and it is intended to cover all such modifications which fall within the spirit and scope of the appended claims.

What is claimed is:

1. A multi-unit package comprising at least two plastic dividers receiving and holding a plurality of unfilled open-ended metal containers having their interior walls coated with an epoxy resin layer, said containers having their open ends in abutting relationship with a first surface of one of said at least two plastic dividers and their bases in abutting relationship with a second surface of the second of said at least two plastics dividers, the open ends of said containers being sealingly engaged with the first surface to form closed spaces wherein migration and/or diffusion of an organoleptic active agent capable of traveling from said first surface encompassed by said open ends to said resin layer is substantially suppressed, said plastic dividers comprising linear polymers selected from the group consisting of polyesters formed by cycloaliphatic diols and dibasic carboxylic acids and polyesters of polyalkyleneterephthalate formed by terephthalic acid and ethylene glycol wherein the alkylene of said polyalkyleneterephthalate is a member selected from the group consisting of methylene, ethylene, propylene, butylene and pentylene, said polyesters being unmodified and free of anti-blocking agent, said polyesters having an intrinsic viscosity of at least about 0.60, and a static coefficient of friction relative to the metal of said containers of about 0.28$\pm$0.02 or 0.37$\pm$0.04.

2. The package as recited in claim 1 wherein the plastic dividers have a thickness of about 0.015 to about 0.025 inches.

3. A multi-unit package as recited in claim 1 wherein said at least two plastic dividers are amorphous sheets of unoriented polyalkyleneterephthalate.

* * * * *